United States Patent [19]

Peyton

[11] Patent Number: 4,555,236

[45] Date of Patent: Nov. 26, 1985

[54] HAND ACTUATED PUPPET AND KIT

[76] Inventor: Jeffrey L. Peyton, 2218 E. Grace St., Richmond, Va. 23223

[21] Appl. No.: 603,912

[22] Filed: Apr. 26, 1984

[51] Int. Cl.[4] ..... A63H 23/00; A63H 3/14; A63H 3/08

[52] U.S. Cl. ..... 446/329; 446/159; 446/388

[58] Field of Search ..... 446/327, 328, 329, 330, 446/337, 338, 339, 385, 387, 388, 359, 368

[56] References Cited

U.S. PATENT DOCUMENTS

| | | | |
|---|---|---|---|
| 2,071,225 | 2/1937 | Buttigieg | 446/337 X |
| 2,680,935 | 6/1954 | Smart | 446/388 X |
| 2,840,950 | 7/1958 | Cotler | 446/329 X |
| 2,959,872 | 11/1960 | Rodgers | 446/487 X |
| 3,055,142 | 9/1962 | Palm | 446/387 X |
| 3,521,399 | 7/1970 | Deal | 446/329 |
| 3,789,546 | 2/1974 | Morrison | 446/327 |
| 3,848,356 | 11/1974 | Wylie et al. | 446/327 X |
| 3,916,537 | 11/1975 | Gilligan et al. | 446/329 X |
| 3,918,180 | 11/1975 | Chamberlin | 446/327 X |
| 3,992,724 | 11/1976 | Bosler | 446/487 X |
| 4,233,772 | 11/1980 | Hamar | 446/329 X |
| 4,372,077 | 2/1983 | Balbuena | 446/327 X |

FOREIGN PATENT DOCUMENTS

| | | | |
|---|---|---|---|
| 8301392 | 4/1983 | Int'l Pat. Institute | 446/327 |
| 1259570 | 1/1972 | United Kingdom | 446/327 |

OTHER PUBLICATIONS

Front Page of No. 540.076 to Frueh dated Apr. 1922.

Pages of No. 1692 to Godrey & Another dated Jan. 1911.

Copyrighted Pop.Pet Action Toys by Graphiyuks received Apr. 1973.

*Primary Examiner*—Robert A. Hafer

*Assistant Examiner*—D. Neal Muir

*Attorney, Agent, or Firm*—Norman B. Rainer

[57] ABSTRACT

A hand-actuated puppet is fabricated of resilient thin flat sheet material which permits the puppet to be compacted to a flat storage configuration amenable to packaging within the cover of a book. The puppet is comprised of upper and lower panels interconnected by a W-shaped hinge which permits the forward extremities of the panels to be brought together and flexibly deformed so as to meet in a coplanar abutment site. The abutment site is capable of gripping flat objects.

Flat objects, having an appearance associated with the appearance of the puppet, may be packaged with the puppet as a kit. Still another kit encompasses the combination of the puppet with related literary material such as a book.

10 Claims, 6 Drawing Figures

HAND ACTUATED PUPPET AND KIT

MATERIAL INFORMATION DISCLOSURE

With respect to the invention described in the attached specification, and pursuant to 37 CFR 1.97—1.99, the following is the closest prior art of which the applicant and the preparer of the specification are aware:

No pertinent prior art is known.

BACKGROUND OF THE INVENTION

This invention concerns puppets useful for entertainment and instructional purposes, and more particularly relates to hand operated puppets having a simple gripping function easily mastered by children.

There are many different kinds of puppets designed to produce entertaining movements based upon the manipulative efforts of the operator. Those puppets which are activated by supporting strings have generally been designated marionettes. Other puppet types are activated by rods or are worn over the hand to permit direct finger manipulation, or involve combinations of such principles. Conventional hand puppets, in their simplest form, require only a head-like flexible shell mounted atop a tubelike costume. It is drawn over the hand, like a glove. The forefinger works the head, and the thumb and middle finger operate the two arms. Such puppets are often sold as toys because even a child can produce movements of the figure that recognizably simulate human or animal movements. Flat puppets, known as shadow figures, are used in conjunction with a directed light source to cast moving shadows upon a screen or other flat surface.

Some puppet types are expensive to manufacture, or are difficult to operate, or are limited in their functional capabilities, particularly in operating upon other objects.

It is accordingly an object of the present invention to provide an inexpensive puppet which is easily operable by children or adults.

It is another object of this invention to provide a puppet as in the foregoing object having a grasping or gripping capability and useful for instructional purposes.

It is a further object of the present invention to provide a puppet of the aforesaid nature having the ability to grasp and lift substantially flat objects lying upon a flat surface.

It is still another object of the invention to provide a puppet of the aforesaid nature which can be stored in a flat state for economy of shipping and convenience of storage.

It is a still further object of this invention to provide a kit adapted for educational or amusement use, said kit comprising a puppet of the aforementioned nature and at least one substantially flat association object liftable by said puppet.

These objects and other objects and advantages of the invention will be apparent from the following description.

SUMMARY OF THE INVENTION

The above and other beneficial objects and advantages are accomplished in accordance with the present invention by an improved puppet fabricated substantially entirely of flat sheet stock material such as cardboard and presenting the general appearance of the front view of an animate head such as a head of a person or animal, said puppet being comprised of a flat upper panel representing the face of a person or animal and having front and rear extremities and upper and lower surfaces, a flat lower panel representing the tongue, jaw or other portion of the person or animal and comprised of front and rear extremities and upper and lower surfaces, said lower panel being adapted to interact with the front extremity of said upper panel, and a W-shaped hinge which interengages said upper and lower panels and is disposed such that the center bight of said hinge is directed toward the rear extremities of said panels.

The hinge is preferably fabricated of folded flat thin sheet stock. One of its straight legs is attached to the lower surface of the upper panel, and the opposite straight leg is attached to the upper surface of the lower panel. The manner of interengagement of the hinge with the panels is such that the lower surface of the upper panel and upper surface of the lower panel are in facing relationship in sandwiching disposition about the hinge. The hinge has a width sufficient to facilitate holding by the fingers of the operator in a manner whereby the thumb is below the center bight and the opposing four fingers are positioned above the bight. When properly manipulated, the upper panel is caused to angle downwardly so that the facing forward extremities of the panels are in abutting contact.

In a preferred embodiment, finger engaging means are associated with the upper and lower straight legs of the hinge. Said finger engaging means may, for example, be pockets formed within each straight leg or formed between the straight leg and the panel to which it attaches. Other finger engaging means may be comprised of elastomeric loops attached at two separated points disposed adjacent the straight legs of the hinge, said loops extending in a direction generally parallel to the center bight. The purpose of the finger engaging means is to better enable the user to manipulate the puppet.

The puppets are designed preferably such as to have a plane of symmetry which vertically bisects said upper and lower panels in the direction running between the front and rear extremities thereof. The flat sheet stock material of which said upper and lower panels are fabricated is reasonably stiff, though sufficiently resilient to enable the panels to bend to a mutual plane at their site of abutting contact, said mutual plane being perpendicular to said plane of symmetry.

The substantially flat association objects to be used in conjunction with the puppets are intended to represent things relating to the particular person or animal the puppet represents, particularly the favorite food of an animal. For example, if the puppet represents a dog, the association object may be a card depicting a bone, or a card cut in the shape of a bone. If the puppet represents a rabbit, the association object may resemble or otherwise suggest a carrot.

In a particularly preferred aspect of the invention, the puppet is packaged in association with a book whose subject matter relates to the nature of the puppet. Such combination kit may be in the form of a compact package amenable to commercial distribution.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 2:
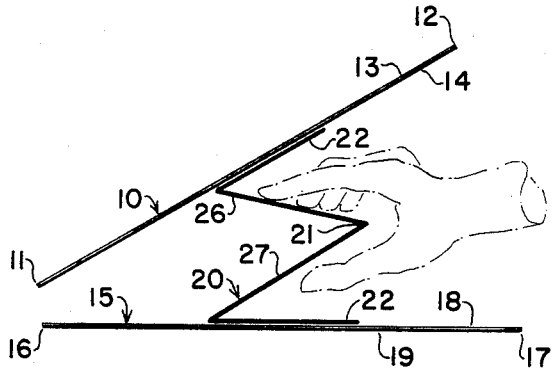
FIG. 2 is a side view of the embodiment of FIG. 1 shown operatively held by the hand of the user.

For convenience in description, the terms "front" and "rear", or words of similar import with respect to the puppet of this invention will have reference to the left and right ends, respectively, of the puppet appearing in FIG. 2. Similarly, the expressions "upper" and "lower", and equivalents thereof, will have reference to the upper and lower portions, respectively, of the puppet shown in FIG. 2.

DESCRIPTION OF THE PREFERRED EMBODIMENTS

Figure 1:
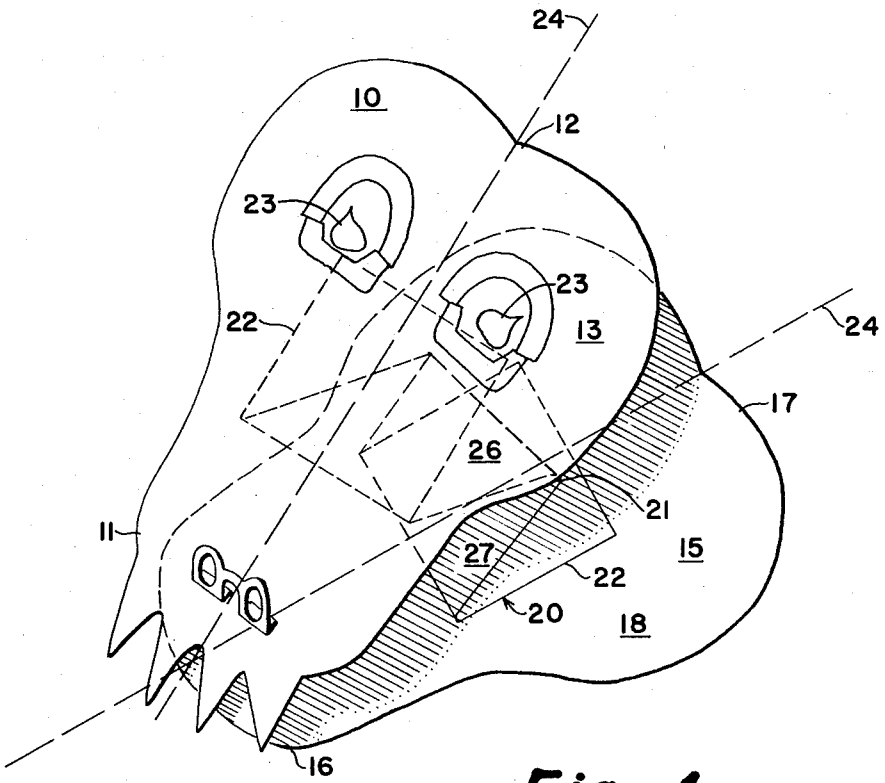
FIG. 1 is a front perspective view of an embodiment of the puppet of this invention.

Referring to FIGS. 1 and 2, a puppet of the present invention is shown comprised of flat upper panel 10 having front and rear extremities 11 and 12, respectively, and upper and lower surfaces 13 and 14, respectively; flat lower panel 15 having front and rear extremities 16 and 17, respectively, and upper and lower surfaces 18 and 19, respectively; and W-shaped hinge 20 having center bight 21, opposed straight legs 22, and upper and lower angled portions 26 and 27, respectively.

Flat upper panel 10 is contoured and decorated in a manner to present the appearance of the face of an animal. Said panel will therefore generally contain indicia or other suitable ornamentation to represent eyes 23. In some embodiments, a nose, ears, eyebrows, eyeglasses or other features associated with a face may be present. Front extremity 11 of upper panel 10 is intended to represent the mouth of the animal. The face represented by upper panel 10 of the puppet of FIGS. 1 and 2 is symmetric about plane 24 which vertically bisects upper panel 10 in an orientation directed between front and rear extremities.

Lower panel 15 is configured and/or decorated in a manner such that front extremity 16 has the appearance of the lower jaw or tongue of the animal. Both the upper and lower panels are fabricated of paper or cardboard sheet stock which is much stiffer than letter-grade paper, yet sufficiently resilient to flex.

The W-shaped hinge is preferably fabricated of the same sheet stock from which said upper and lower panels are fabricated. The hinge must have a sufficient width of between 1½ and 4 inches so as to facilitate grasping and manipulation, but should not protrude beyond the boundaries of the panels. The upper straight leg 22 lies flush against lower surface 14 of said upper panel, and the lower straight leg lies flush against upper surface 18 of said lower panel. The legs are bonded to said surfaces preferably by adhesives. It is to be noted that the line of bight 21 is oriented perpendicularly to said plane of symmetry.

In the case of the puppet shown in FIGS. 1 and 2, the lower panel serves the further purpose of a lower gripping member, the reason being that the configuration of the panels and their orientation about the hinge permits abutting contact at a site adjacent their front extremities. In its operational configuration, the puppet of FIGS. 1 and 2 is manipulated by grasping the angled portions of the hinge in a manner such that the thumb engages lower angled portion 27, and the opposed four fingers engage upper angled portion 26.

Figure 6:
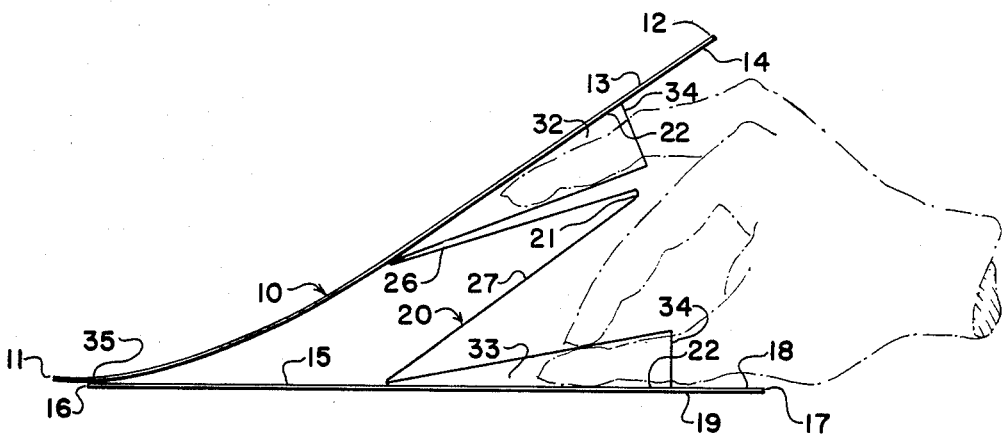
FIG. 6 is a side view of an embodiment of the puppet provided with finger engaging means in the form of pockets, and shown operatively held by the hand of the user.

In the embodiment of FIG. 6, finger engaging means in the form of pockets 32 and 33 are associated with upper and lower straight legs respectively. Each pocket is elongated in the direction extending between front and rear portions of the puppet, and is provided with an opening 34 directed toward the rear of the puppet. In operation, three or four fingers of the user are inserted into the upper pocket, and the thumb is inserted into the lower pocket. The index finger may be brought to bear against the outside of the lower pocket in abutment with the thumb within the pocket. The pockets are fabricated either by virtue of the use of a convolutely folded strip as the hinge, or by selectively adhering just the long edges of the straight legs to their respective panels.

FIG. 6 further illustrates the manner of bending of the panels at the site of abutting contact 35 adjacent their front extremities. Said site of contact is seen to be a mutual plane oriented perpendicularly to the plane of symmetry.

Figure 3:
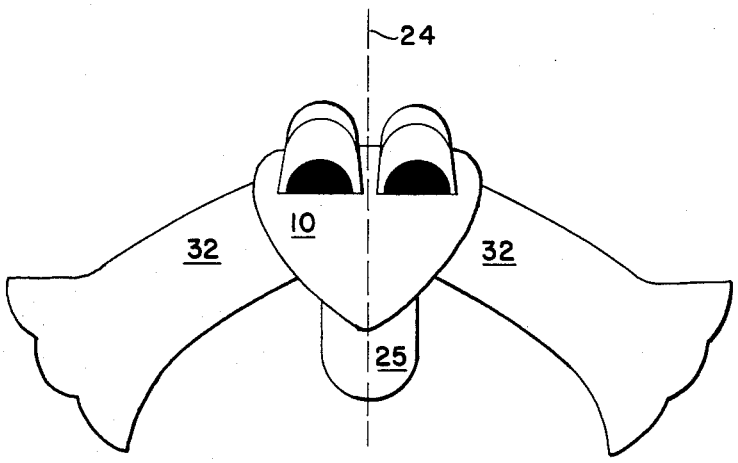
FIG. 3 is a top view of another embodiment of the puppet of this invention in its flattened or storage condition.
Figure 4:
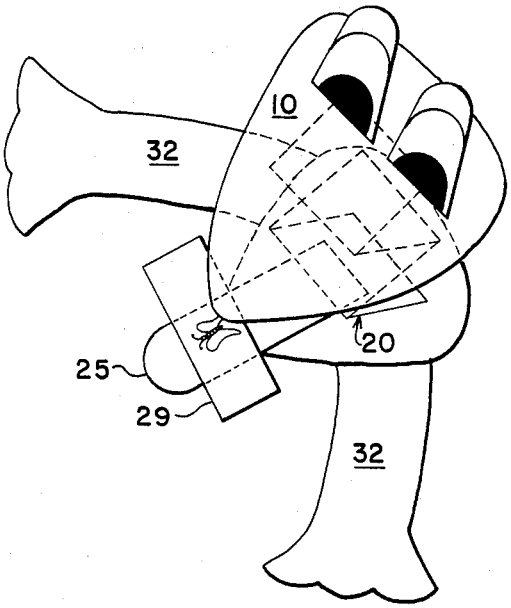
FIG. 4 is a front perspective view of the puppet of FIG. 3 shown engaging a card depicting an object to be associated with the appearance of the puppet.

The puppet illustrated in FIGS. 3 and 4 is intended to represent a frog. For appearance effect, a pair of legs 32 are attached to lower surface 19 of lower panel 15. Although the upper and lower panels of the frog embodiment are designed to come together in flush engagement adjacent the forward extremities thereof, additional lower lifting means are provided in the form of tongue 25 which protrudes forwardly of the panels from a site of attachment upon the lower angled portion 27 of hinge 20. Because of its attachment to lower angled portion 27, the tongue reaches downwardly and is eminently suited for sliding under flat objects lying upon a flat surface. To further enhance its ability to slide under flat objects, the tongue is preferably fabricated of a sheet material thinner than the panels.

FIG. 4 illustrates the puppet in gripping contact with an association object in the form of a flat card 29 showing a butterfly.

Figure 5:
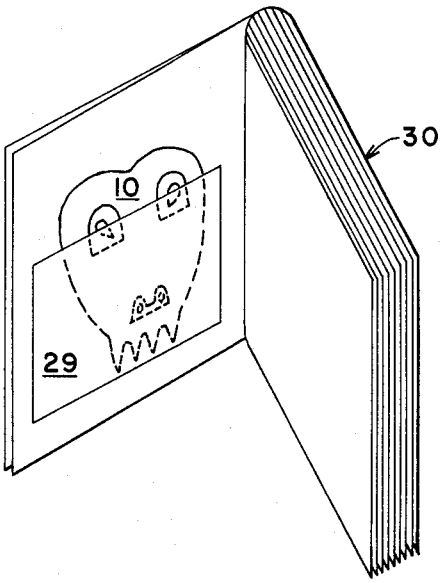
FIG. 5 is a perspective view of a partially opened book showing the storage of a puppet in the inside cover of said book.

The puppets, in their flattened storage configuration, and the flat association objects can be readily accommodated within storage means such as a pocket 29 of a book 30, as shown in FIG. 5. The puppet may also be associated with other literary material as a game, or as an instructional program, or a coordinated system wherein the puppet supplements the content of the literary material. For example, if the literary material is a story book about a dog, the puppet may resemble a dog. If the literary material is of an instructional nature aimed at word recognition, the association objects may depict letters of the alphabet, or short words. Such combinations of literary material plus the puppet constitute a still further kit embraced within the purview of this invention.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A hand actuated puppet fabricated substantially entirely of resilient thin flat sheet material and presenting the general appearance of the head of a person or animal, said puppet being comprised of:

(a) a flat upper panel representing the face of a person or animal and having front and rear extremities and upper and lower surfaces, (b) a flat lower panel representing a lower portion of the person or animal and comprised of front and rear extremities and upper and lower surfaces, and (c) a folded W-shaped hinge capable of being collapsed to a planar configuration, said hinge interengaging said upper and lower panels and disposed such that the outer legs of said W-shaped hinge are attached to opposing surfaces of said upper and lower panels inwardly of said front extremities, said inner legs forming a center bight directed toward the rear extremities of said panels, said hinge having a width sufficient to facilitate holding by the fingers of the operator, (d) said upper and lower panels being adapted to be hand-manipulated in a manner to cause them to bend and meet in abutting contact in a mutual plane at a site adjacent their front extremities, said site of abutting contact being capable of gripping flat objects, (e) the design and construction of said puppet being such as to facilitate interconversion between an operational configuration and a flattened storage configuration.

2. The puppet of claim 1 wherein said hinge is of integral construction, comprised of opposed straight legs, and upper and lower angled portions which define said center bight.

3. The puppet of claim 2 wherein a tongue protrudes forwardly of said panels and is adapted to slide under flat objects lying upon a flat surface.

4. The puppet of claim 3 wherein said tongue is downwardly directed from a site of attachment on the lower angled portion of said hinge.

5. The puppet of claim 2 wherein finger engaging means are associated with said opposed straight legs.

6. The puppet of claim 5 wherein said finger engaging means are rearwardly opening elongated pockets.

7. A kit in the form of a compact package amenable to commercial distribution comprising:

A. a hand actuated puppet fabricated substantially entirely of resilient thin flat sheet material and presenting the general appearance of the head of a person or animal, said puppet being comprised of:

(a) a flat upper panel representing the face of a person or animal and having front and rear extremities and upper and lower surfaces, (b) a flat lower panel representing a lower portion of the person or animal and comprised of front and rear extremities and upper and lower surfaces, and (c) a folded W-shaped hinge capable of being collapsed to a planar configuration, said hinge interengaging said upper and lower panels and disposed such that the outer legs of said W-shaped hinge are attached to opposing surfaces of said upper and lower panels inwardly of said front extremities, said inner legs forming a center bight directed toward the rear extremities of said panels, said hinge having a width sufficient to facilitate holding by the fingers of the operator, (d) said upper and lower panels being adapted to be hand-manipulated in a manner to cause them to bend and meet in abutting contact in a mutual plane at a site adjacent their front extremities, said site of abutting contact being capable of gripping flat objects, (e) the design and construction of said puppet being such as to facilitate interconversion between an operational configuration and a flattened storage configuration, (f) said puppet being in its storage configuration, and (B) literary material whose content is related to the puppet's appearance.

8. The kit of claim 7 wherein said literary material is a book.

9. The kit of claim 8 wherein said book is provided with storage means which accommodate said puppet.

10. The kit of claim 7 wherein said puppet is accompanied by at least one substantially flat association object liftable by said puppet.

* * * * *